US006979205B2

(12) United States Patent
Hoopes et al.

(10) Patent No.: US 6,979,205 B2
(45) Date of Patent: Dec. 27, 2005

(54) MODULAR SIGNAL AND POWER CONNECTION DEVICE

(75) Inventors: Gerald B. Hoopes, Petaluma, CA (US); Steven Newell, Petaluma, CA (US)

(73) Assignee: Panamax, Petaluma, CA (US)

( * ) Notice: Subject to any disclaimer, the term of this patent is extended or adjusted under 35 U.S.C. 154(b) by 93 days.

(21) Appl. No.: 11/058,389

(22) Filed: Feb. 15, 2005

(65) Prior Publication Data

US 2005/0176275 A1 Aug. 11, 2005

Related U.S. Application Data

(62) Division of application No. 10/788,073, filed on Feb. 5, 2004.

(51) Int. Cl.[7] ..... H01R 12/00
(52) U.S. Cl. ..... 439/76.1; 174/53
(58) Field of Search ..... 439/653, 535–536, 439/578–585, 607–610, 76.1; 174/53

(56) References Cited

U.S. PATENT DOCUMENTS 3,369,153 A 2/1968 Arnold et al.
3,693,053 A 9/1972 Anderson
3,753,421 A 8/1973 Peck
4,023,071 A 5/1977 Fussell
4,089,032 A 5/1978 Dell Orfano
4,152,743 A 5/1979 Comstock
4,168,514 A 9/1979 Howell
4,210,906 A 7/1980 Smith et al.
4,249,224 A 2/1981 Baumbach
4,317,154 A 2/1982 Passarella
4,389,695 A 6/1983 Carpenter, Jr.
4,438,477 A 3/1984 Cawley
4,451,108 A * 5/1984 Skidmore ..... 439/536
4,455,586 A 6/1984 McCartney
4,500,862 A 2/1985 Shedd
4,547,827 A 10/1985 Shedd
4,616,104 A 10/1986 Lindsey
4,626,057 A 12/1986 Knickerbocker
4,630,163 A 12/1986 Cooper et al.
4,642,733 A 2/1987 Schacht
4,677,518 A 6/1987 Hershfield
4,698,721 A 10/1987 Warren
4,739,436 A 4/1988 Stefani et al.
4,742,541 A 5/1988 Cwirzen et al.
4,743,999 A 5/1988 Hames
4,745,882 A 5/1988 Yarnall, Sr. et al.
4,760,485 A 7/1988 Ari et al.
4,807,083 A 2/1989 Austin
4,835,650 A 5/1989 Epstein
4,882,647 A 11/1989 Collins
4,903,161 A 2/1990 Huber et al.
4,918,565 A 4/1990 King
4,922,374 A 5/1990 Mueller et al.
4,937,722 A 6/1990 Deierlein
4,944,698 A 7/1990 Siemon et al.
4,968,264 A 11/1990 Ruehl et al.

(Continued)

*Primary Examiner*—Michael C. Zarroli

(57) ABSTRACT

An electrical connection box for wall mounting provides a recessed external plug for receiving or transmitting power to electronic components. The connection box is configured to receive a variety of signal connection modules for interconnecting associated audio/visual electronics such as DVD players, displays and the like in adjacent apertures. The signal connection modules are inserted or extracted from the face of the connection box; replacing blanking plates, and is optionally recessed from the face of the box into the wall cut-out. The configuration and mating features of the box and modules also provides for a common and isolated ground reference for surge protection of the connected components.

21 Claims, 4 Drawing Sheets

FIG. 3A

FIG. 3B

U.S. PATENT DOCUMENTS 4,996,945 A 3/1991 Dix
5,032,946 A 7/1991 Misencik et al.
5,089,925 A 2/1992 Lester
5,130,881 A 7/1992 Hilland
5,153,806 A 10/1992 Corey
5,177,782 A 1/1993 Henderson et al.
5,216,569 A 6/1993 Brookhiser
5,224,013 A 6/1993 Pagliuca
5,233,501 A * 8/1993 Allen et al. ..... 361/733
5,278,720 A 1/1994 Bird
5,348,491 A * 9/1994 Louwagie et al. ..... 439/188
5,365,395 A 11/1994 Callaway
5,377,067 A 12/1994 Tanaka et al.
5,388,021 A 2/1995 Stahl
5,410,443 A 4/1995 Pelegris
5,412,526 A 5/1995 Kapp et al.
5,423,697 A 6/1995 MacGregor
5,483,409 A 1/1996 Heidorn et al.
5,486,650 A * 1/1996 Yetter ..... 174/53
5,488,535 A 1/1996 Masghati et al.
5,537,044 A 7/1996 Stahl
5,543,999 A 8/1996 Riley
5,552,962 A * 9/1996 Feustel et al. ..... 361/733
5,555,153 A 9/1996 Frederiksen et al.
5,617,288 A 4/1997 Zaretsky
5,691,872 A 11/1997 Cohen
5,734,542 A 3/1998 Cohen
5,757,603 A 5/1998 Kapp et al.
5,768,081 A 6/1998 Cohen et al.
5,885,096 A * 3/1999 Ogren ..... 439/188
5,896,265 A 4/1999 Glaser et al.
5,914,662 A 6/1999 Burleigh
5,978,198 A 11/1999 Packard et al.
6,146,192 A * 11/2000 Cabalka et al. ..... 439/540.1
6,147,304 A 11/2000 Doherty
6,188,557 B1 2/2001 Chaudhry
6,226,162 B1 5/2001 Kladar et al.
6,226,166 B1 5/2001 Gumley et al.
6,229,682 B1 5/2001 Mechanic
6,252,754 B1 6/2001 Chaudhry
6,282,075 B1 8/2001 Chaudhry
6,385,030 B1 5/2002 Beene
6,414,241 B1 7/2002 O'Donnell
6,420,964 B1 * 7/2002 Nishikawa et al. .... 340/310.08
6,541,700 B2 * 4/2003 Chiriku et al. ..... 174/50
6,572,413 B2 * 6/2003 Olson et al. ..... 439/668
6,587,354 B1 * 7/2003 Kutsch et al. ..... 361/788
6,606,232 B1 8/2003 Vo et al.
6,614,636 B1 9/2003 Marsh
6,700,062 B1 * 3/2004 Allen, Jr. ..... 174/53
6,719,585 B2 * 4/2004 Egbert ..... 439/578
6,778,375 B1 8/2004 Hoopes
6,790,080 B2 * 9/2004 Cannon ..... 439/551
6,872,097 B2 * 3/2005 Johnsen et al. ..... 439/668

* cited by examiner

MODULAR SIGNAL AND POWER CONNECTION DEVICE

CROSS REFERENCE TO RELATED APPLICATIONS

This application is a division of and claim priority to U.S. application Ser. No. 10/788,073, filed Feb. 5, 2004, for a "Modular Signal and Power Connection Device", which is incorporated herein by reference.

BACKGROUND OF INVENTION

The current invention relations to wall mounted electrical junction box for power and low voltage signal connections of related electronic components.

Electronic components used in audiovisual systems are subject to damage from electrical power surges. Numerous technologies and designs exist for either disconnecting equipment from such damaging conditions, or shunting the power to a ground connection via a nonlinear component. However, effective implementation of the schemes and designs requires interconnected components to be connected with a single ground source.

Moreover, typical audiovisual systems utilizes multiple powered components, which are interconnected to receive and transmit relatively low voltage signals. To the extent that some of these components are physically separated from other components, for example the visual display unit for home theater system might be located across the room from a cabinet containing the DVD player or high-definition television encoder, low voltage signal wire cabling is preferably routed through walls to avoid physical hazards as well as a cluttered appearance.

Although power and signal cables might be physically separated outside of the interconnected components, over voltage conditions, arising from unstable line voltage, or lightning strikes, can propagate through multiple components in the absence of an appropriately designed system. Accordingly, there exists a need for connection devices that can facilitate the installation of multiple, physically separated audiovisual components of them in a manner that readily provides necessary surge protection.

Their exists a further need for connection devices that can be readily installed in walls and accommodate a wide variety of low voltage signal connectors to might be encountered when combining various types of displays, video processors, audio equipment, data communication equipment and/or computers.

There remains a further need for such a connection devices that permits various audiovisual components to be mounted nearly flush to the structural walls or other architectural features yet the same time accommodate a variety of connected plugs sizes.

SUMMARY OF INVENTION

The above and other objectives of the invention is satisfied in a first aspect by providing a connection box for wall installation that has a front face that covers substantially all of a cut-out in a wall. Within the front face is a first cavity extending inward to receive a power cord plug at a socket disposed at the bottom of the cavity, for example, a power plug connector having line, neutral and ground terminals. The corresponding socket has input terminal for L, N and G disposed behind the socket an aperture for receiving at least one of a blanking plate & a signal connection module, two or more walls disposed on opposing sides of the aperture and extending inward face. Walls in electrical contact connection with at least one of the ground input or output terminal of the socket. Thus, power plugs can be recessed into the connection box, permitting a nearly flush mounting of the associated A/V components.

In a second aspect of the invention, a signal connection module or blanking plate is inserted into the aperture cover the remainder of the aperture, avoiding an opening between the wall interior and the room. The module or blanking plate is supported by the walls on opposing sides of the apertures.

In another aspect of the invention, the signal connection module is dimensioned for insertion into the aperture within the front face of the aforementioned connection box. Accordingly, the signal connection module has a substantially flush front face with one or more sockets for receiving corresponding signal plugs from the associated A/V equipment. The signal module also has at least two adjacent sides connected to the front face of the module that fit closely between corresponding walls extending inward from the aperture in the connection box. Low voltage signal output connectors emerging rearward from behind the front face, corresponding to the multiple low voltage signal input sockets disposed on front face of the module. The two or opposing sides of the module are in electrical connection with ground shield wires associated with the low voltage signal wires that connect the input and output connectors in the module, providing electrical continuity to a common ground associated with the power socket ground wire via physical contact with wall associated with the aperture in the connection box. Electrical continuity is maintained over a range of alternative displacement of the signal module with the connection box aperture, thus both the signal and power plugs can be recessed into the connection box, permitting a nearly flush mounting of the associated A/V component.

As will be further described, other aspects of the invention include mechanical features for grasping, moving and latching the signal module at variable position rearward from the front face of the connection box, as well as connection boxes configured to receive an array of signal connection modules, with or without blanking plates.

The above and other objects, effects, features, and advantages of the present invention will become more apparent from the following description of the embodiments thereof taken in conjunction with the accompanying drawings

BRIEF DESCRIPTION OF DRAWINGS

FIG. 3A is an elevation of the connection box taken through the wall bisecting the signal connection module; whereas FIG. 3B is an exterior elevation as observed from the room.

DETAILED DESCRIPTION

Figure 1:
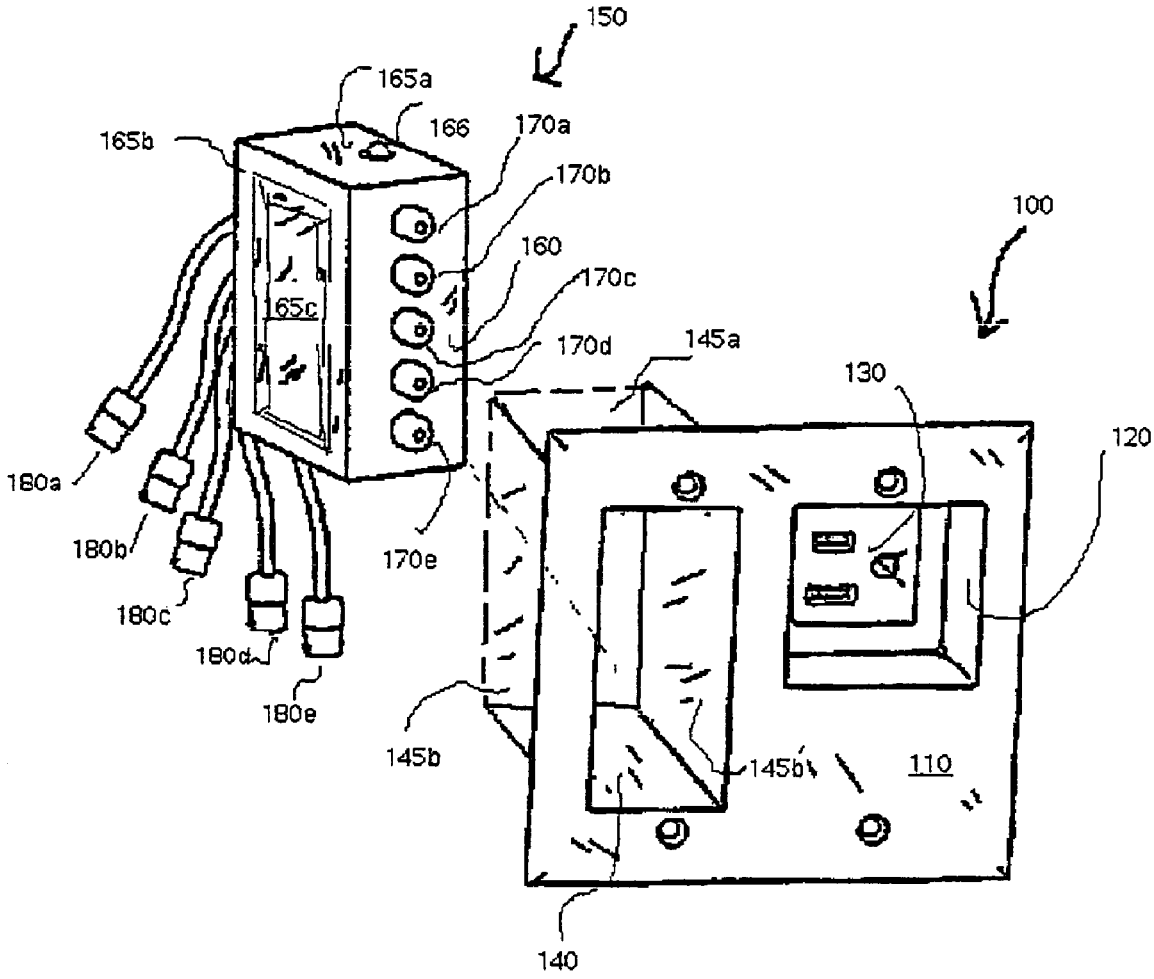
FIG. 1 is an exploded perspective view showing the connection box and signal connection module.

FIG. 1 illustrates in an exploded perspective view the connection box 100 and signal connection module 150 for use therewith. Connection box 100 has a front face 110 for mounting substantially flush with a surface, generally a room interior wall. Although signal connection module 150 is normally inserted into the connection box from the front face 110 side of connection box, it is shown behind the front face for illustration purposes. Connection box 100 has a first cavity 120 that extends inward, that is toward the interior of the wall, from the front face 110 for receiving a power connector in socket 130 disposed at the bottom of the cavity 130. Accordingly, socket 120 has electrically isolated input sockets for receiving plug prongs for connecting the corresponding line, neutral and ground wires thereto. Although not shown in this Figure it should be understood that connection box 100 also includes corresponding line, neutral and ground connection terminals for receiving bare conductor wire mounted behind the socket. The aforementioned components are however illustrated in a schematic electrical circuit diagram of FIG. 2. The front face 110 of connection box 100 also includes at least one aperture 140 for receiving either a blanking plate 105 (shown in FIG. 4) or a signal connection module 150. Signal connection module 150 is inserted into aperture 140 and thus supported by two or more sidewalls, 145*a* and 145*a*' that are disposed on opposing sides of the aperture 140 to extend inward from the front face 110. In this embodiment, two additional side walls 145*b* and 145*b*' connect with walls 145*a* and 145*a*' to form a box like enclosure. Further details of the construction and operation of the signal module 150 are described below and in particular with reference to FIGS. 3 and 4.

It should be appreciated that power socket 120 is optionally selected to receive either straight prong connector plug, as illustrated, or a twist lock plug, and can be any plug type, particularly when it is desired to limit the connection to a single electronic component with a mating power cord connector, such as a power conditioning module. Connection box 100 also has a plurality of holes at the periphery of face 120 that are disposed to align with convention terminal box, or J-Box, located behind the wall, the terminal box being generally required by electrical and building codes. Thus, screws inserted in these holes secure physical stability of connection box 100 with respect to the wall or other planar surface. In the most preferred embodiment, connection box 100 extends like a flange about the periphery of the front face 120. Such a flange extension conceals the J-box, but is more preferably limited in outer dimensions for receiving a decorative cover plate. The outer or peripheral dimensions of front face 110 are slightly small than a conventional decorative wall plate, should a user or consumer wish to cover a portion of face 120 for aesthetic reasons.

As will be further described with reference to FIGS. 2, 3 and 4, at least one of the sidewalls 145*a*/145*a*' and 145*b*/145*b*' of connection box 100 contact and provide electrical continuity with at least one of the ground input or output terminal of socket 130.

Signal connection module 150 has a front face 160 and at least two opposing sides 165*a* and 165*a*' parallel to each other and disposed perpendicular to the front face 160. Multiple low voltage signal input sockets 170*a, b, c, d* and *e* are also disposed on front face 160. Corresponding multiple low voltage signal output connectors 180*a, b, c, d* and *e* emerge rearward from behind the front face 160 having separate parallel to corresponding to input sockets 170*a–e*. Further, in this preferred embodiments shown, output connectors 180*a–e* are separated from the rearward portion of signal connection module 150 by a lengths of signal wire cable 181*a* to 181*e*. The signal wire cable extends output connectors 180*a–e* away from signal connection module 150 to enable the convenient installation of signal wire from the room after connection box 100 is installed. That is, signal connection module 150 can be inserted from the room side of connection box 150. Accordingly, it should be appreciated that the signal connection module are readily reconfigured after an initial installation, should the user or consumer wish to deploy alternative A/V sources. The signal cables 181*a* to 181*e* provide slack, and hence effective strain release, for cable running behind the wall when the signal connection module is installed or reconfigured. Further, the signal wire cable 181*a* to 181*e* enable the use of larger output sockets than might not fit on the front face 160 of signal connection module 150, but would still fit in the space behind or within the wall. Further, as is more fully described with respect to FIG. 3, additional mating components associated with the sides of signal connection module 150 and connection box 100 permit signal connection module 150 to be offset at multiple positions within aperture 140. Such features include a spring-loaded ball 166, which is mounted within signal connection module 150 and extends partially through a hole in the upper surface 165*a* of connection module 150. As the associated spring urges ball 166 into the hole and a corresponding orifice on the opposing face of the aperture wall 145*a*, the signal connection module 150 is secured in aperture 140, but still readily removable by the application of sufficient lateral force to overcome the retaining force of the associated spring. Accordingly, on moving the signal connection module laterally within aperture 140, ball 166 is displaced back into the signal module, out of contact with the opposing face of the aperture wall. Thus, the placement of multiple mating orifices on the same opposing face permits a variable adjustment of the recess of the front face 160 of signal module 150 behind the face 110 of connection box 100, as further described with respect to FIGS. 3 and 4 below. Referring to the schematic electrical circuit of FIG. 2, it should be apparent that the two opposing sides 160 of signal connection module 150 make electrical contact connection with ground shield wires associated with 2 or more of the signal i/o sockets 170/180. Thus at least one of the sidewalls 165*a*/*a*',*b*/*b*' makes electrical contact with one of walls 145*a*/*a*',*b*/*b*' associated with the aperture in the connection box 100 to provide a common ground connection between the circuit sub modules in the Figure, However, it should be further appreciated that the electrical continuity between the respective ground wires in the signal module and the connection box is insured by the springs urging of ball 166 into contact with both the signal module and the connection box components.

In a more preferred embodiment, at least one of the sides 165*b* of signal connection module 150 has a recessed flat panel, 165*c*, for receiving a label for displaying printed matter such as product identification, installation instructions and the like. Placing the printed labels within recessed panel 165*c* avoids the wear or degradation of the label on the otherwise contacting face of the sides walls 145*b* of aperture 140 in connection box 100.

According, the front face 160 of signal connection module 150 optionally includes any variety and combination input sockets and output sockets or output plugs, such as RCA, VGA, Co-axial cable, phone, data communications, Ethernet type, and the like. It should be further appreciated that extension cable 181*a–e* can be of any length, and can be eliminated depending on the need for the optional adjustability of signal connection module 150 within aperture 140, the skill of the installer, or the intended permanence of the installation.

Figure 2:
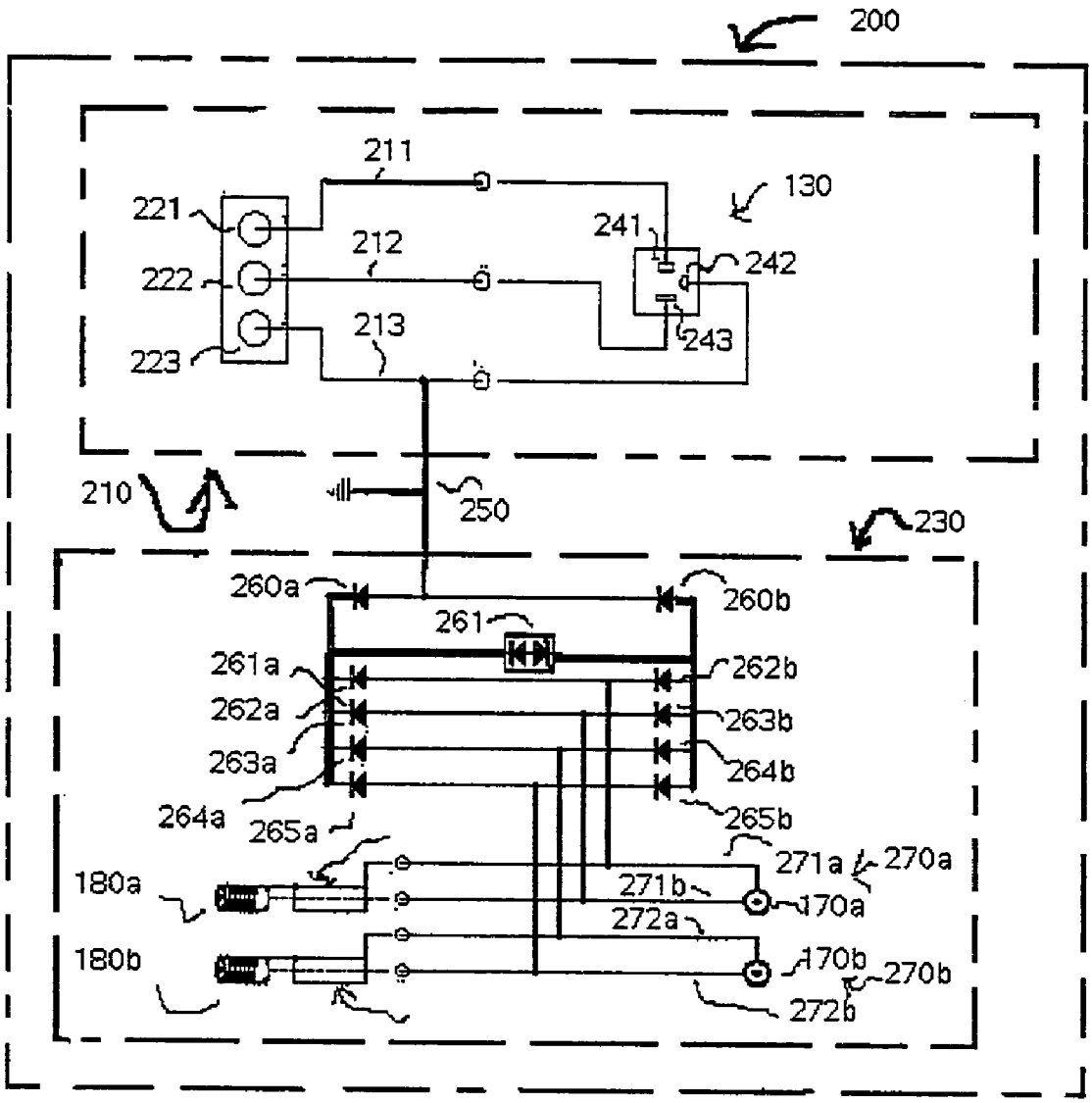
FIG. 2 is a schematic electric circuit for the connection box and signal connection module

The electrical schematics of circuit 200 in FIG. 2 further illustrates other aspects of the invention wherein optional signal protection, power protection (collectively SP) or power conditioning components are interconnected via a common ground connection between the signal connection circuit module 230 and the ground wire of socket 130 of the power circuit module 210. It should be appreciated that the actual circuit protective function in signal protector module 210 and an AC protector module 220 is accomplished by limiting voltage differences between wires passing to the protected A/V equipment (PE) to levels safe for the equipment. If the allowable voltage difference between two terminals of the equipment is exceeded, either an insulating path isolating the connections will flash over, or a component connecting the two terminals will overheat and be damaged. Since both the number of terminal connections and the allowable voltage differences vary widely from one piece of equipment to another, surge protectors must be specially designed to meet the needs of the PE. Broadly, the connection to PE can be defined as being either "Power" (e.g., 120VAC in many cases), or "signal" connections. Power connections provide for the power supplies for the PE, as well as powering AC-powered equipment such as monitors and display, as well as DVD players, amplifiers and the like. Signal connections are generally of lower voltage and current than power connections, and are used to transmit information and control among different pieces of the PE. Typically, but not always, the AC connections will withstand larger voltages than the signal connections.

Thus, in FIG. 2, the separate socket terminal on the face power plug 130 sockets, denoted as line voltage (L) 241, Ground (G) 242 and neutral (N) 243, are connected by wire 211, 222 and 223 to respective rear connection terminals 221, 222, and 223. The rear connection terminals are for securing conventional interior power wiring, per local electrical and building codes. Ground wire 213 is represented as connecting to a common ground to emphasize the electrical continuity between the signal connection module and connection box, shown as circuit trace 250. The signal connection module 150 preferably has an over-voltage protection circuit 230, which is disposed in serial connection between each of the signal paths 270*a* through *e* connecting the isolated I/O terminals 170/180 *a–b*. Note that additional I/O terminals, such as those described with respect to FIG. 1 are omitted merely to simplify the diagram, the number and type in each Figure being exemplary and not intended to limit the scope of the invention.

Each pair of input connectors shown in this diagram, 270*a* and 270*b*, comprises an outer conductor, usually signal ground, which flows to respective output terminal 180*a* and 180*b* over signal wires 271*a* and 272*a*. Central socket conducts of sockets 170 and 170*b* connect to the center pin of output thermals 180*a* and 180*b* via signal wires 271*b* and 272*b*.

Signal wire lines 271*a*/*b* and 272*a*/*b* are in fact preferably formed on a printed circuit board (PCB) to facilitate interconnection with the protection circuitry. Thus, each individual signal wire line in circuit 230 is in a parallel connection with a protected path to ground trace 250 via a pair of isolating diodes, that is signal wire 272*b* is isolated from both a unidirectional voltage limiting device 261 and diode 260*b*, which lead to ground, by diode pair 265*a* and 265*b*. Whereas is signal wire 272*b* is isolated from unidirectional voltage limiting device 261 and diode 260*b* by diode pair 264*a* and 264*b*, and likewise for signal wire 271*b* (diode pair 263*a*/*b*) and signal wire 271*a* (diode pair 262*a*/*b*.) Thus, the diode pairs limit any excess current from the signal wires to flow clockwise to device 261, which acts in the reverse bias condition to set the protecting or clamp voltage for the protected A/V equipment. Thus, in this preferred embodiment rectifier Diodes 260*a* and 260*b* direct current that is shunted from the signal lines upon an over voltage conditions, as defined by the voltage threshold of the device 261, such that the shunted current will flow in the clockwise direction to trace 250 and then to ground. Unidirectional voltage limiting device 262 is preferably a silicon avalanche diode (SAD), 261 also isolates the signal module traces 270*a* and 270*b* from high currents that could otherwise be conducted through diode 260*a*, upon high voltages surges occurring within power circuit 210.

It should be appreciated that FIG. 2 is not intended as a limiting examples, as further surge protection circuit are optionally provided in circuit sub module 210 in a parallel connect to ground for the L, N and G lines of the power socket, or as a serial connected circuit for filtering out AC line noise.

Figure 3:
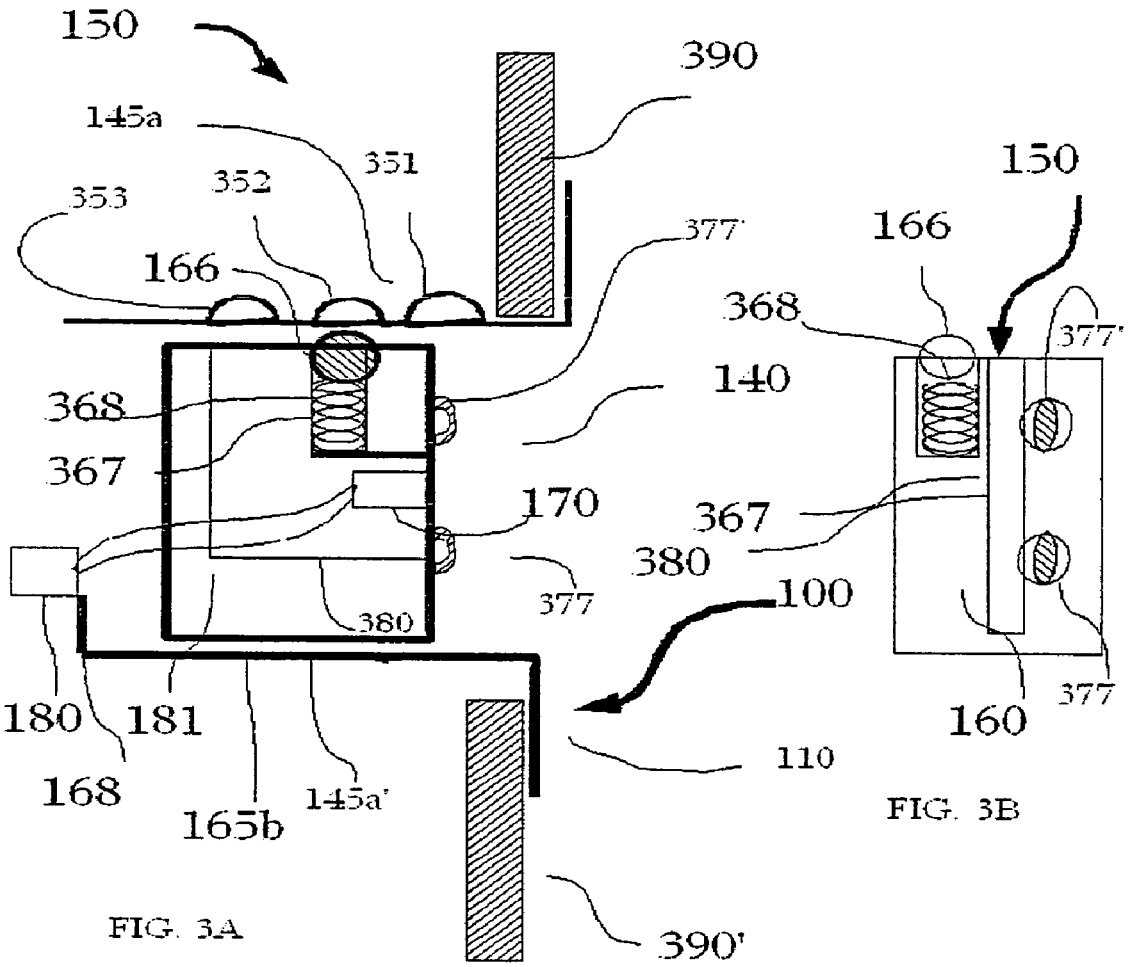

FIG. 3 illustrates further the mechanical features of a preferred embodiment of the invention, shown in elevation taken through an installed signal connection module taken orthogonal to the wall (represented by segments 390 and 390' above and below the signal connection box respectively.) Connection box aperture walls 145*a* has indentation(s) for receiving a mating feature disposed on the sidewalls of the signal module. Note that in this embodiment, signal connection module 150, while slideable within aperture 140 is disposed at the intermediate of three positions, being removeably secured by the displacement of ball 166 into the second of three hemispherical depressions that extend upward into wall 145*a* of aperture 140. Thus, the placement of the hemispherical depressions defines a plurality of latched positions for signal module 150 within aperture 140. A spring 367 is fixed at one end to a portion of connection module 150 with the opposing end extending upward to urge ball 166 out of a circular hole formed in the upper surface 165*a* of signal connection module 150. According on pulling or pushing module 150 in the lateral direction the force of spring 167 is overcome such that ball 166 can then can secure the connection module in an alternative position by engaging either of the adjacent hemispheres, 353 and 351. As ball 166 is spring loaded, it provides for a secure electrical connection from connection box 100 to signal module 150. The spring is preferably supported within the bore of a threaded shaft 367, the shaft bottom being either closed, or having a diameter small than the diameter of spring 368. The threaded shaft 367 is then inserted into a nut or other component with mating thread on the inside of wall 165*a* box below the hole that limits the spring-loaded ball from extending there through. It should be appreciated that alternative embodiments to a latching function supplied by the spring-loaded ball include other types of spring members, possibly without a ball, but direct spring contact. Further embodiments that perform substantially the same function include, without limitation, plural mating feature on each signal connection module, such as holes or hemispherical depressions, with a spring-loaded ball or hemisphere extending from the aperture sidewall. In this alternative embodiment, the ball or hemisphere would retracts into the aperture wall s signal connection module or blanking plate is translated within aperture 140 of connection box 100.

The ball 266 and mating features in aperture wall 145 *a* or a 45 *b* are preferably offset to one side of the center line of signal connection module 150 to provide maximum space for signal connection sockets centered on the front face 160 of signal connection module 150, as well as leaving the maximum space and height for a PC board 380 and associated surge protection components.

FIG. 3 also illustrates one embodiment of a mechanical feature suitable for grasping and either sliding or removing the signal connection module from the room side. A grip-receiving member 377 is preferably formed by providing an adjacent pair of slits to define a narrow strip of metal. The narrow strip of metal is then deformed outward from face 160 to form grip-receiving member 377 as an isthmus that extends several millimeters outward to the room side. Accordingly, a gripping tool can be inserted at the slit edges to reach behind and grip member 377 from the room side of the connection box. It should be appreciated that grip receiving member 377 is alternatively formed as an inward protruding indentation formed about slits in the front face. In the latter embodiment, the gap between the slits and the punched in isthmus provide access to insert an alternative tool behind the back of the front face to grasp and remove the signal connection module there from. In either case, a preferred form of tool is essentially a plier with suitable dimensioned tips to grasp one or more of grip receiving member 377 and retract the signal connection module 150 back into the room. Further, a pair of grip receiving members 377 and 377' are preferably disposed offset from the centerline of signal connection module such that they do not interfere with the placement of signal sockets on the front face, or a printed circuit board (PCB) 380 mounted within the signal connection module. Further, the Connection box 150 preferably includes one or more backstops 168 that extend laterally at the rearward end of apertures walls 145*a* or 145*b* and thus preclude signal connection module 150 from accidentally being pushed through aperture 140 and falling behind the wall 377.

In addition, a plurality of a sequence of hemispherical depressions akin to 351, 352 and 353 are preferably disposed at equal offset from the vertical center line through aperture 140, on the bottom wall 165*b*, but omitted for clarity, for removable engagement of an additional spring loaded ball (also omitted for clarity) disposed at the bottom surface 165*a'* of signal connection module 150.

Figure 4:
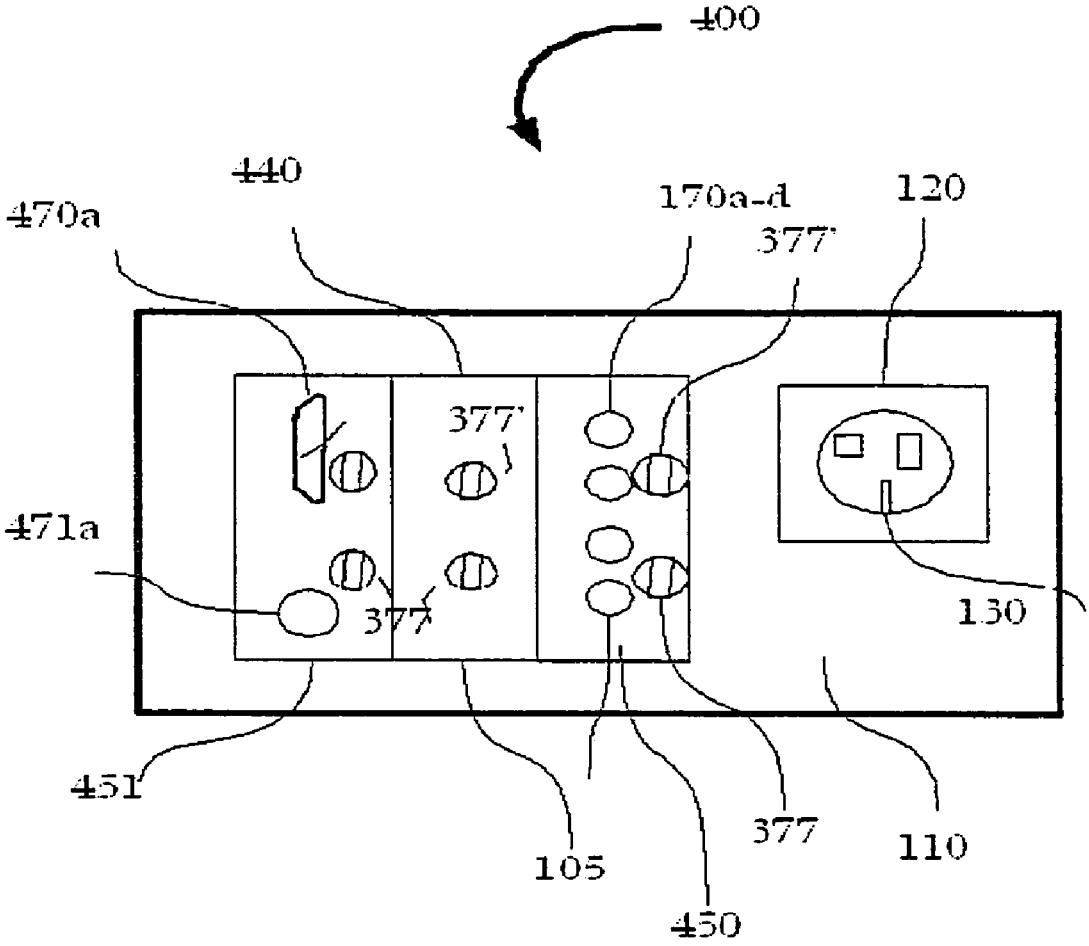
FIG. 4 is an elevation of an alternative embodiment of the connection box including an installed signal module as observed from the room.

FIG. 4 further illustrates the mechanical features of an alternative embodiments of the invention. Multiple signal modules and blanking plates are illustrated in an elevation of connection box 400 as viewed from the room side. Thus, connection box 400 has a wider aperture 440 than aperture 140 in FIG. 1, to accommodate three signal connection modules. In this Figure, signal connection module 450 and 451 are disposed on opposing sides of blanking plate 440. Each of the signal module and the blanking place has one or more of substantially identical grip member 377*a, b* or *c* disposed on their front face. Further, each of signal connection modules 451 and 450 deploy distinctly different types and combinations of low voltage signal sockets. That is signal connection module 451 includes a substantially rectangular multi-pin connector terminal 470*a* and a round connector terminal 471*a'*. It should be appreciated that a multi-pin connector optionally replaces any round connector illustrated, which is round or substantially rectangular. Further, any of the output terminals on the rear side of the signal connection module 150, such as 180*a–e* in FIG. 1, are optionally configured as male or female connections, screw or spring loaded terminals for receiving bare conductor or insulation displacement style terminals, and the like.

Also illustrated in further detail in FIG. 4 is a blanking plate 105 having the same exterior dimensions as signal connection module 150, with a substantially planar front face, and a ball 166', or other latching member, extending from face 165*a'* to provide the same adjustable function as ball 166 on signal connection module 150. Blanking plate 105 need not include additional side faces, provided that face 165*b*, and a corresponding face at the bottom of blanking plate 105, or other mechanical features, provide sufficient structural rigidity. Similarly, in the signal connection module 150 side faces 165*b* and opposing side face 165*b'* (not shown) are also optional, being provided to house and protect electrical component and terminal within signal connection module 150.

It should be appreciated that the exemplary protection circuit shown in FIG. 2 is not intended as limiting examples, as further surge protection circuitry is optionally provided on a PCB adjacent but behind the power socket 130, being operative to shunt current from high voltage transients in the power lines. In other selected embodiments, a noise filtering circuit is optionally provided on a PCB adjacent but behind the power socket 130.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

What is claimed is:

1. A signal connection module comprising:

a) a front face, b) at least two opposing sides parallel to each other and disposed perpendicular to said front face, c) a plurality of low voltage signal input sockets disposed on said front face, d) a plurality of low voltage signal output connectors disposed behind said front face and emerging rearward there from, e) wherein at least one of said input sockets and said output connector connect at least one signal wire and a corresponding ground wire, and f) at least one of said signal wires and said ground wires being in electrical connection to a sidewall of the signal module, and g) means for latching the module in a connection box having an adjacent power socket wherein the latching means complete the ground connection to the ground of the power socket.

2. A signal connection module according to claim 1 wherein the ground wire is disposed as a co-axial shield about the signal wire.

3. A signal connection module according to claim 1 wherein said latching means comprises a cavity in at least one of said opposing side walls for receiving a mating feature disposed on the side walls of the connection box.

4. A signal connection module according to claim 1 further comprising a grip-receiving member disposed on the front face thereof for removal from the front of the connection box.

5. A signal connection module according to claim 4 and further comprising:

a. extension cables providing electrical continuity between the output connectors at a first end disposed behind said front face, and to the input connectors disposed on said front face.

6. A signal connection module according to claim 1, wherein at least on of said input sockets and said output connectors are selected from the group consisting of RCA, VGA, Co-axial cable, phone, data communications and Ethernet type connectors.

7. A signal connection module according to claim 1 further comprising:

a. extension cables providing electrical continuity between the output connectors at a first end disposed behind said front face, and to the input connectors disposed on said front face.

8. A signal connection module according to claim 1, wherein at least one of said input sockets and said output connectors are selected from the group consisting of RCA, VGA, Co-axial cable, phone, data communications and Ethernet type connectors.

9. A signal connection module comprising:

a) a front face, b) At least two opposing side parallel to each other and disposed perpendicular to said front face, c) a plurality of low voltage signal input sockets disposed on said front face, d) a plurality of low voltage signal output connectors disposed behind said front face and emerging rearward there from, e) wherein at least one of said input sockets and said output connector connect at least on signal wire and a corresponding ground wire, and f) at least one of said signal wires and said ground wires being in electrical connection to a sidewall of the signal module, and g) wherein at least one of said opposing parallel sides has a recessed panel for receiving a printed label.

10. A signal connection module according to claim 9 further comprising means for latching the module in a connection box having an adjacent power socket wherein the latching means complete the ground connection to the ground of the power socket.

11. A signal connection module according to claim 10 wherein said latching means comprises a cavity in at least one of said opposing side walls for receiving a mating feature disposed on the side walls of the connection box.

12. A signal connection module according to claim 9 further comprising a grip-receiving member disposed on the front face thereof for removal from the front of the connection box.

13. A signal connection module according to claim 9 further comprising:

a. extension cables providing electrical continuity between the output connectors at a first end disposed behind said front face, and to the input connectors disposed on said front face.

14. A signal connection module according to claim 9, wherein at least one of said input sockets and said output connectors are selected from the group consisting of RCA, VGA, Co-axial cable, phone, data communications and Ethernet type connectors.

15. A signal connection module comprising:

a) a front face, b) at least two opposing sides parallel to each other and disposed perpendicular to said front face, c) a plurality of low voltage signal input sockets disposed on said front face, d) a plurality of low voltage signal output connectors disposed behind said front face and emerging rearward there from, e) wherein at least one of said input sockets and said output connector connect at least one signal wire and a corresponding ground wire, f) at least one of said signal wires and said ground wires being in electrical connection to a sidewall of the signal module, and g) further comprising a grip-receiving member disposed on said front face for removal from the front of a connection box.

16. A signal connection module according to claim 15 further comprising means for latching the module in a connection box having an adjacent power socket wherein the latching means complete the grounding connection to the ground of the power socket.

17. A signal connection module according to claim 15 wherein said latching means comprises a cavity in at least one of said opposing side walls for receiving a mating feature disposed on the side walls of the connection box.

18. A signal connection module according to claim 15 further comprising extension cables providing electrical continuity between the output connectors at a first end disposed behind said front face, and to the input connectors disposed on said front face.

19. A signal connection module according to claim 15, wherein at least one of said input sockets and said output connectors are selected from the group consisting of RCA, VGA, Co-axial cable, phone, data communications and Ethernet type connectors.

20. A signal connection module according to claim 16 further comprising:

a. extension cables providing electrical continuity between the output connectors at a first end disposed behind said front face, and to the input connectors disposed on said front face.

21. A signal connection module according to claim 16, wherein at least one of said input sockets and said output connectors are selected from the group consisting of RCA, VGA, Co-axial cable, phone, data communications and Ethernet type connectors.

* * * * *